US005228551A

United States Patent [19]

Klüttermann et al.

[11] Patent Number: 5,228,551

[45] Date of Patent: Jul. 20, 1993

[54] METHOD AND APPARATUS FOR TRANSFERRING COILER CANS TO AND FROM A CAN TRANSPORTING CARRIAGE

[75] Inventors: Jürgen Klüttermann; Manfred Langen; Gregor Gebald, all of Mönchengladbach; Martin Bungster, Viersen, all of Fed. Rep. of Germany

[73] Assignee: Trützschler GmbH & Co. KG, Mönchengladbach, Fed. Rep. of Germany

[21] Appl. No.: 924,526

[22] Filed: Aug. 4, 1992

[30] Foreign Application Priority Data

Aug. 17, 1991 [DE] Fed. Rep. of Germany ..... 4127292

[51] Int. Cl.[5] ..... B65G 47/04

[52] U.S. Cl. ..... 198/468.11; 198/747

[58] Field of Search ..... 198/468.11, 468.9, 468.4, 198/747, 749, 736, 803.9, 803.8, 803.7, 803.5, 803.3

[56] References Cited

U.S. PATENT DOCUMENTS 3,880,294 4/1975 Arseneault ..... 198/803.8 X
3,987,889 10/1976 Godoy ..... 198/747 X
4,694,539 9/1987 Langen .

FOREIGN PATENT DOCUMENTS 343048 10/1978 Austria .
0340459 11/1989 European Pat. Off. .
0427024 5/1991 European Pat. Off. .
2326950 12/1974 Fed. Rep. of Germany .
3621370 3/1987 Fed. Rep. of Germany .
3928648 3/1991 Fed. Rep. of Germany .
2181755 4/1987 United Kingdom .

*Primary Examiner*—D. Glenn Dayoan
*Attorney, Agent, or Firm*—Spencer, Frank & Schneider

[57] ABSTRACT

A transporting carriage for conveying a coiler can of curved outer circumferential surface in an upright orientation between a can stand of a sliver producing fiber processing machine and a can stand of a sliver comsuming fiber processing machine includes an apparatus for transferring the coiler can from the carriage to the can stand and from the can stand to the carriage in a linear transferring direction. The apparatus includes a gripper element having a jaw opening defined by an inner concave surface of the gripper element for engaging the coiler can along a portion of the curved outer circumferential surface; a turning mechanism for rotating the gripper element along a path generally parallel to the curvilinear length to alter an orientation of the jaw opening; and a linear shifting arrangement for linearly displacing the gripper element parallel to the linear transferring direction for placing the gripper element into a first position in which it is situated within an outline of the carriage and into a second position in which it is situated externally of the outline.

13 Claims, 5 Drawing Sheets

15
16
13
A
9
13'
1b'
1b
8
B
C
D
E
F
G
H
I
K
L
6a
6a'

METHOD AND APPARATUS FOR TRANSFERRING COILER CANS TO AND FROM A CAN TRANSPORTING CARRIAGE

CROSS REFERENCE TO RELATED APPLICATION

This application claims the priority of German Application No. P 41 27 292.7 filed Aug. 17, 1991, which is incorporated herein by reference.

BACKGROUND OF THE INVENTION

This invention relates to a method and an apparatus for transporting coiler cans in a spinning plant between a sliver producing machine (such as a carding machine) and a sliver consuming machine (such as a drafting frame) and/or an intermediate station by means of a transporting carriage which is associated with a loading and unloading device whose gripping and conveying elements are linearly shifted. The gripping elements serve the purpose of grasping the coiler can whereas the conveying elements transfer the coiler cans to or from the transporting carriage.

In a conventional method, by means of a loading and unloading device mounted on the transporting carriage, a coiler can filled with sliver or an empty coiler can is transferred to or is taken from the transporting carriage. The gripping device has two horizontal telescoping cylinders having respective pistons. At the end of one piston a pressure cylinder is provided at an angle of 90° which operates in a direction radial to the coiler can and firmly clamps the coiler can against the oppositely located other pressure cylinder. For adapting the gripping device to the round outer surface of the coiler can, two curved, short clamping pieces are provided. First, the clamping pieces are shifted in a linear direction tangentially relative to the coiler can in such a manner that the coiler can is placed between the clamping pieces. Between the clamping pieces and the lateral coiler can surface only narrow spaces remain. The clamping pieces are short to ensure that the can fits therebetween when it is grasped. The stroke of the pressure cylinder which is mounted transversely on a horizontal telescoping cylinder is also short. Thereafter the coiler can is, as the pressure cylinder moves radially in the direction of the coiler can, radially frictionally firmly grasped by the clamping pieces.

In the above-outlined grasping process the gripping of the coiler cans requires a very accurate positioning of the transporting carriage at the coiler can stand, because each coiler can has to be positioned (in the x-direction) with very small lateral distances in the intermediate space between the two clamping pieces which face one another. In addition, the telescoping cylinders with the clamping pieces must also be very accurately positioned relative to the coiler can (y-direction) to ensure that the short clamping pieces securely grasp the outer surface of the coiler can. Such an accurate positioning of the clamping pieces in the longitudinal and transverse directions is complicated and may easily lead to operational disturbances.

SUMMARY OF THE INVENTION

It is an object of the invention to provide an improved method and apparatus of the above-outlined type from which the discussed disadvantages are eliminated and which, in particular, permits a secure grasping and conveyance of the coiler cans in a simple and rapid manner.

This object and others to become apparent as the specification progresses, are accomplished by the invention, according to which, briefly stated, the transporting carriage for conveying a coiler can of curved outer circumferential surface in an upright orientation between a can stand of a sliver producing fiber processing machine and a can stand of a sliver comsuming fiber processing machine includes an apparatus for transferring the coiler can from the carriage to the can stand and from the can stand to the carriage in a linear transferring direction. The apparatus includes a gripper element having a jaw opening defined by an inner concave surface of the gripper element for engaging the coiler can along a portion of the curved outer circumferential surface; a turning mechanism for rotating the gripper element along a path generally parallel to the curvilinear length to alter an orientation of the jaw opening; and a linear shifting arrangement for linearly displacing the gripper element parallel to the linear transferring direction for placing the gripper element into a first position in which it is situated within an outline of the carriage and into a second position in which it is situated externally of the outline.

The measures according to the invention make possible a secure grasping and conveying of the coiler cans in a simple and rapid manner. A further advantage is in the simplification of the precise positioning of the gripper and carrier elements. A further advantage resides in the form-locking straddling and form-locking guidance of the cans.

The apparatus according to the invention has the following additional advantageous features:

The jaw opening of the gripper element has the shape of a circular segment.

The jaw opening of the gripper element is shaped as a semicircular arc.

The jaw opening of the gripper element is a one-piece component.

The jaw opening of the gripper element is formed of at least two parts, such as circular arc sections.

A drive mechanism which is provided for turning the gripper element, includes a stationary drive motor having a toothed gear, a sprocket or the like, being in engagement with a toothed countercomponent connected with the gripper element, for example, an arcuate toothed rack, a sprocket belt or the like.

The gripper element is movable along a horizontal track.

The driving mechanism for turning the gripper element is mounted on a carrier element which linearly shifts the gripper element and which has at least one pneumatic cylinder.

The carrier element has at least one toothed rack displacement device.

Opposite the carrier element there is provided a guide element, for example, a guide rail in a parallel relationship therewith.

The guide element is shiftable parallel in the direction of the carrier element.

Sensors (can stand location markings) are associated with the transporting carriage and the can readying stations at the sliver producing machine (card) and/or the sliver consuming machine (drafting frame) and/or intermediate stations.

On the transport carriage two carrier elements are arranged each having a gripper element with its own drive mechanism.

BRIEF DESCRIPTION OF THE DRAWINGS

FIGS. 3*a*–3*l* are schematic top plan views depicting sequential steps in the performance of a loading, conveying and unloading process according to the invention.

DESCRIPTION OF THE PREFERRED EMBODIMENTS

Figure 1:
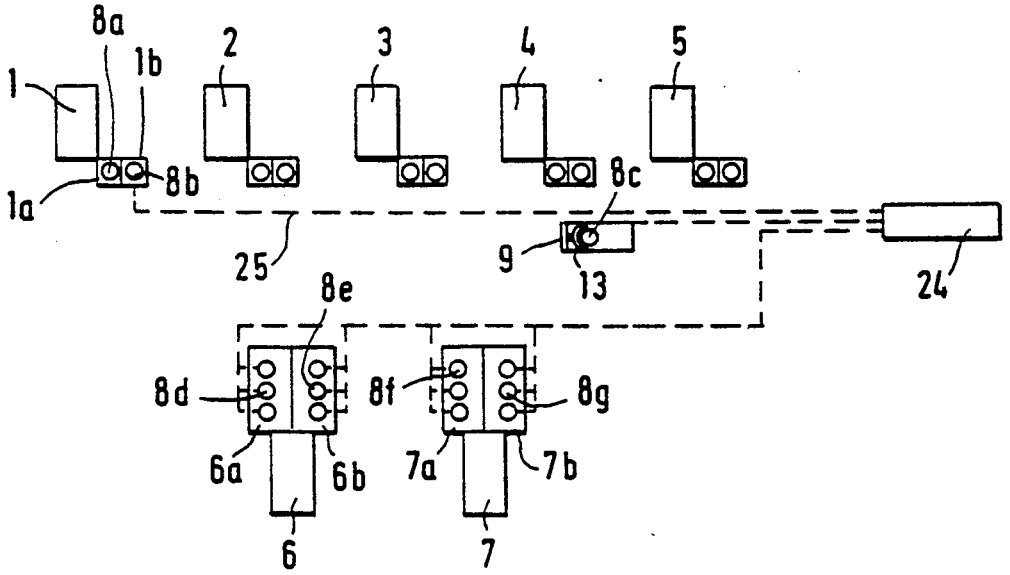
FIG. 1 is a schematic top plan view of a spinning preparation system which includes five carding machines and two drafting frames and which incorporates the invention.

The system illustrated in FIG. 1 is formed of five carding machines 1 through 5 which may be, for example, EXACTACARD DK models manufactured by Trützschler GmbH & Co. KG, Mönchengladbach, Germany as well as two drafting frames 6 and 7. The carding machines are sliver-producing fiber processing machines whereas the drafting frames are sliver-consuming (utilizing) fiber processing machines. Each carding machine 1–5 is associated with a feeding apparatus (sliver coiler) 1*a* for depositing the sliver, produced by the respective carding machine, into a coiler can 8*a*. Adjacent the sliver coiler 1*a* there is disposed a pickup station 1*b* for removing the filled coiler cans 8*b* from the sliver coiler apparatus. The sliver coiler 1*a* and the pickup station 1*b* may be components of a conventional coiler can replacing mechanism.

For transporting a coiler can 8*c* between the carding machines 1–5 on the one hand and the drafting frames 6 and 7, on the other hand, a transporting carriage 9 is provided which carries the coiler can 8*c* to the standby stations 6*a*, 6*b* of the drafting frame 6 or the standby stations 7*a*, 7*b* of the drafting frame 7. The stations 6*a*, 6*b* each accommodate three cans 8*d*, 8*e*, while the stations 7*a*, 7*b* each accommodate three cans 8*f*, 8*g*. The coiler cans 8*e* and 8*g* are situated at the inlet of the drafting frames 6 and 7, respectively; in that position sliver is taken from the respective cans and supplied to the drafting mechanism of the drafting frames 6 and 7 for doubling and stretching as a preparation for spinning. It is to be understood that instead of three coiler cans 8*e* and 8*g* a greater or smaller number of coiler cans 8*e* and 8*g* may be positioned simultaneously at the inlet of the respective drafting frames 6 and 7 when a different type of doubling is required. Further, a reserve station 24 is provided for the coiler cans 8 which is disposed between the carding machines on the one, hand and the drafting frames on the other hand and may receive or dispatch empty and/or filled coiler cans 8 in a railroad switching yard fashion. The travelling path of the transport carriage 9 is indicated at broken lines.

Figure 2:
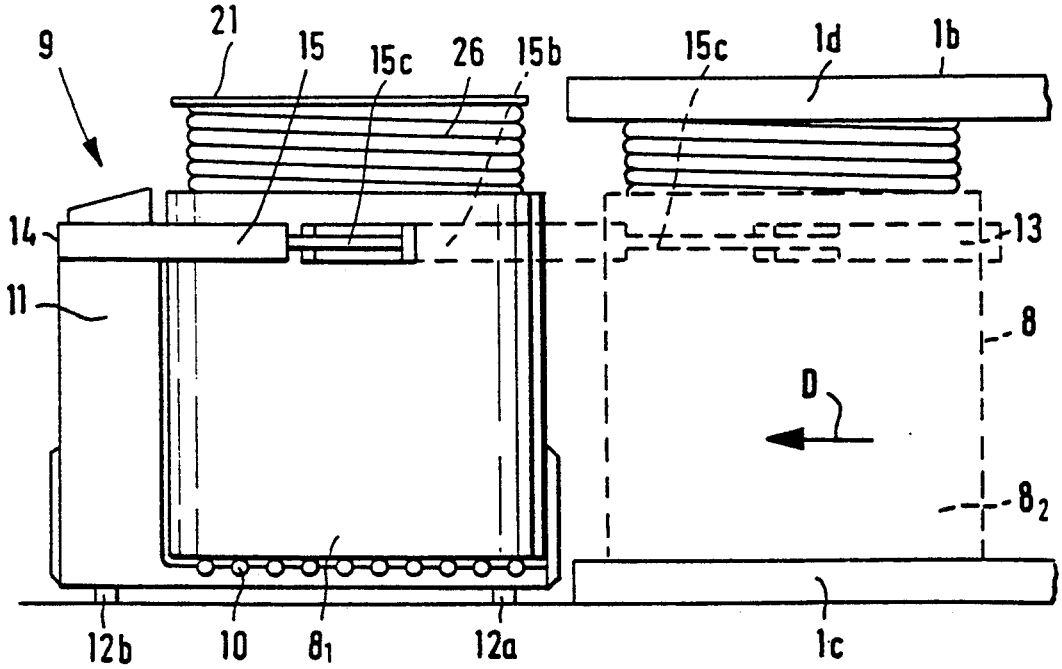
FIG. 2 is a schematic side elevational view of a preferred embodiment of the invention.

Turning now to FIG. 2, there is illustrated therein the transport carriage 9 which is designed for handling one coiler can at a time. The coiler can has a diameter of, for example, 1,000 mm. The can 8 to be transferred to a can stand associated with one of the carding machines 1–5 or one of the drafting frames 6, 7 is positioned on a roller track 10 which is mounted on the carriage 9 and which is positioned at a height of about 120 mm above the ground. The chassis of the transport carriage 9 accommodates the non-illustrated drive for propelling the transport carriage as well as a drive for a telescoping cylinder 15, energy supply devices and the like. The chassis is provided with four wheels 12 (only two wheels are visible) and has a steerable shaft, not shown. The coiler can 8 is situated on the transport carriage 9 generally within a rectangular outline defined by the four wheels 12 as shown, for example, in FIG. 4.

The loading and unloading device (transferring device) for the coiler can 8 includes a gripper element 13 which is mounted on the chassis 11 by means of a horizontally oriented telescoping power cylinder unit 15 having pistons 15*a*, 15*b* and 15*c*. The gripper element 13 is disposed at the end of the piston 15*b*.

Figures 3A, 3B, 3C, 3D, 3E, 3F, 3G, 3H, 3I, 3K, 3L:
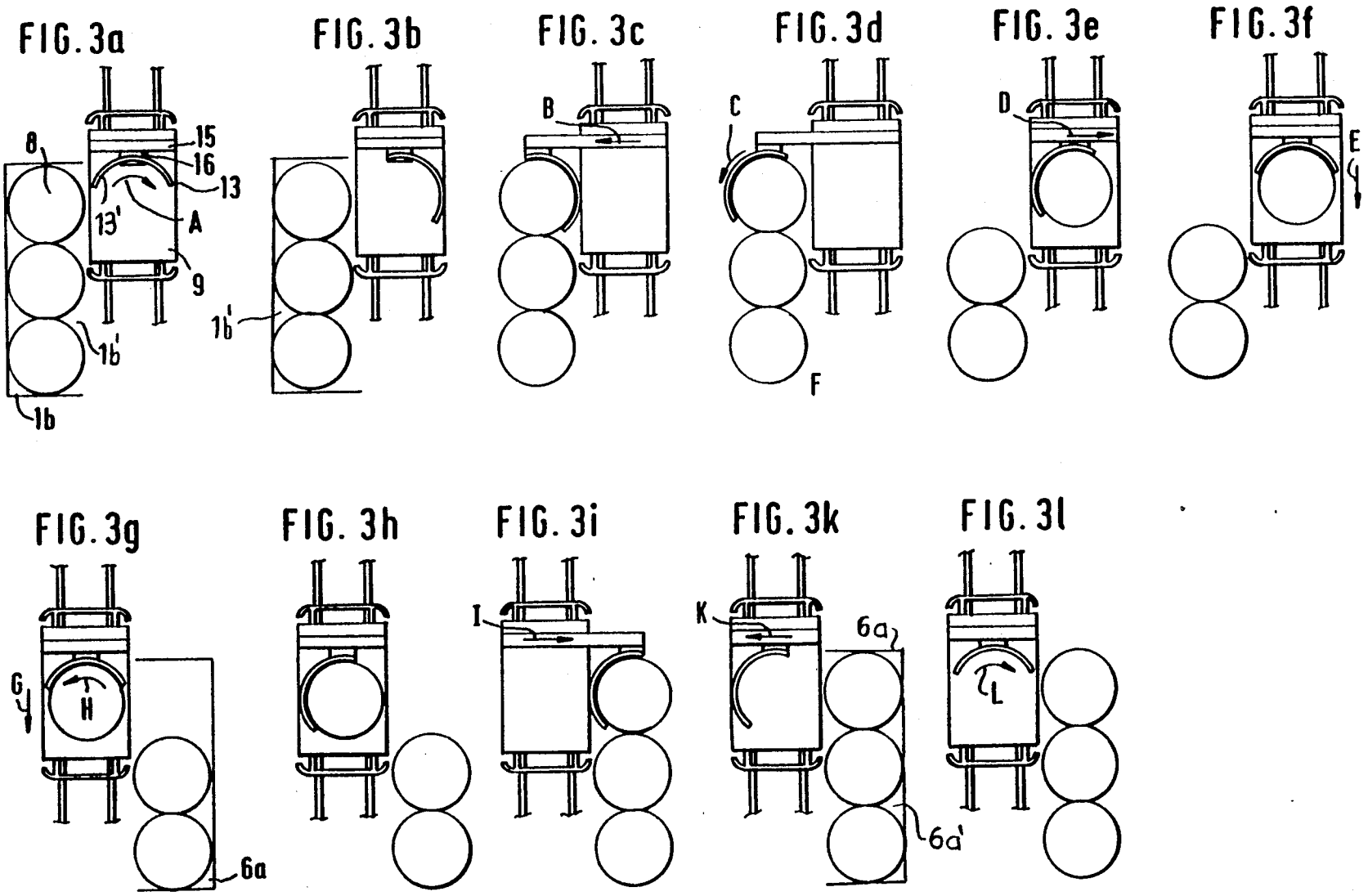

As depicted in FIG. 3*a*, three full coiler cans 8 are supported in an upright orientation on a stand 1*b*' at the pickup station 1*b* of the carding machine 1. For engaging and moving the top (leading) coiler can 8 onto the transport carriage 9, the gripper element 13, having an inner concave engagement surface 13' (constituting a jaw opening) is turned in the direction of arrow A With respect to its holding element 16 in such a manner that its jaw opening is oriented towards the top can 8 (that is, towards the stand 1*b*') as illustrated in FIG. 3*b*. Thereafter, the gripper element 13 is, together with its holder 16, linearly shifted by the power cylinder 15 in the direction B until the gripper element 13 circumferentially engages the outer surface of the can 8 as illustrated in FIG. 3*c*. It is noted that a linear shifting mechanism including the power cylinder 15 is disclosed in more detail in U.S. Pat. 4,683,619 which is hereby incorporated by reference. Thereafter, as shown in FIG. 3*d*, the gripper element 13 is moved relative to the holder 16 in a horizontal plane in an arcuate direction coaxially to the can 8, that is, substantially along the curved plane defined by the gripper element surface 13', until the jaw opening of the gripper element 13, while remaining in engagement with the can 8, is oriented towards the transporting carriage 9. Thereafter, as shown in FIG. 3*e*, the gripper element 13 is linearly shifted by the transferring element (power cylinder) 15 in the direction of the arrow D until the can is transferred onto the transport carriage 19. During such a transfer motion the can 8 is form-fittingly guided by the gripper element 13.

Thereafter, as illustrated in the sequential FIGS. 3*f* and 3*g*, the transporting carriage 9 leaves the pickup station 1*b* of the carding machine 1 in the direction of the arrow E, then travels to the drop-off station 6*a* associated with the non-illustrated drafting frame 6 as indicated by the arrow G in FIG. 3*g*. It is further seen that prior to the carriage travel, the gripper element 13 is turned coaxially to the can 8 until the jaw opening of the gripper element 13 is oriented towards the direction of travel E, G.

Upon arrival of the transport carriage 9 into the station 6*a*, the gripper element 13 is turned in the direction of the arcuate arrow H coaxially to the transported can 8 until the jaw opening of the gripper element 13 is oriented similarly to FIG. 3*d*. This position is shown in FIG. 3*h*. Thereafter, the gripper element 13 is, together with the can 8, linearly shifted as indicated by the arrow I in FIG. 3*i* until the can is moved onto the stand 6*a*' of the station 6*a*.

Subsequently, the gripper element 13 is withdrawn linearly in the direction of the arrow K until it assumes its position within the outline of the transporting carriage 9 and, as a last step before the carriage 9 leaves the station 6*a*, the gripper element 13 is moved arcuately relative to its holder 16 as shown in FIG. 31, to assume the same position as illustrated in FIG. 3*a*.

Figure 4:
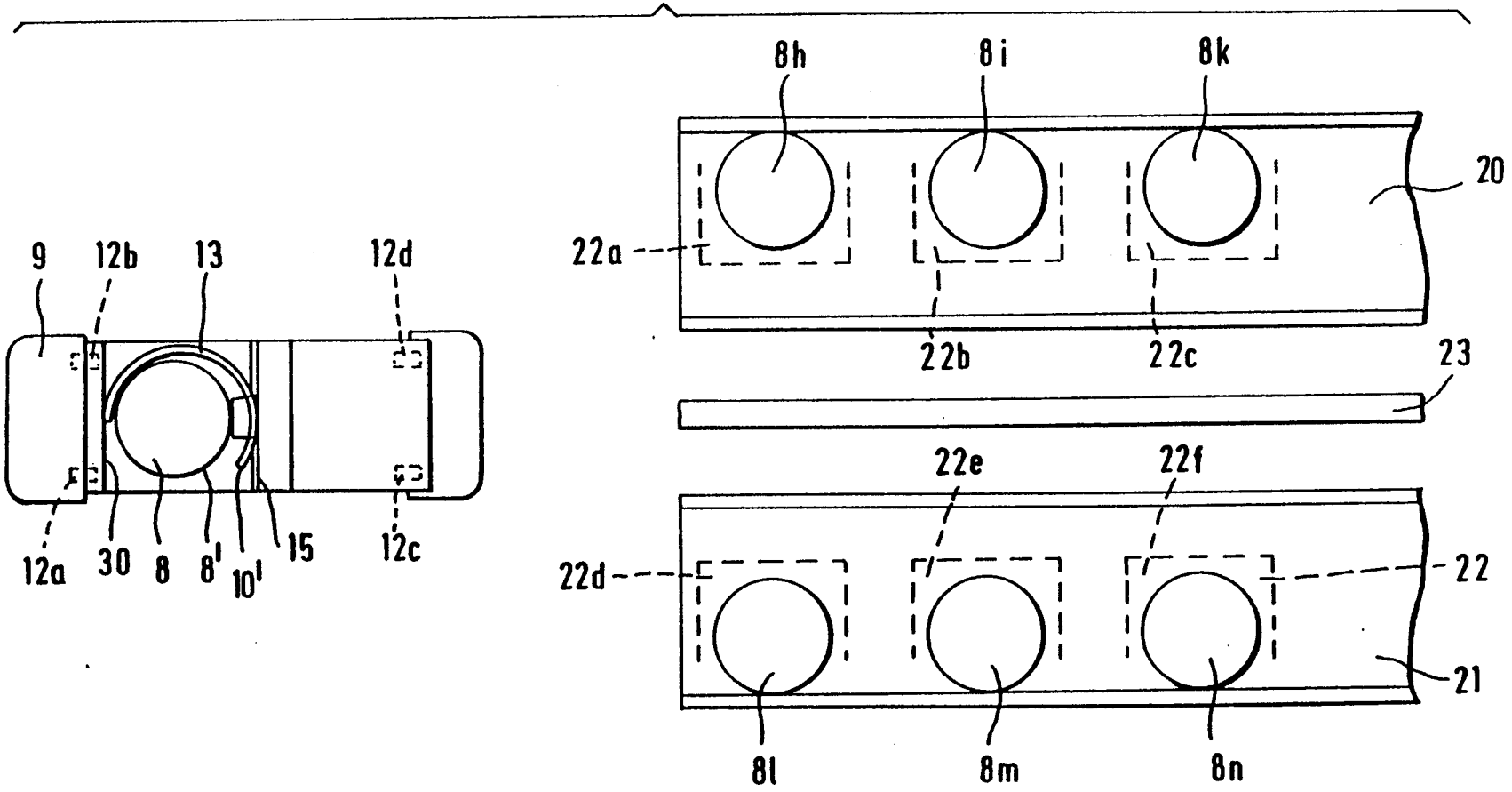
FIG. 4 is a schematic top plan view of the preferred embodiment of the invention, performing a bilateral loading and unloading process.

In the arrangement illustrated in FIG. 4 there are provided two side-by-side arranged, parallel-oriented can standby ramps 20 and 21. Between the ramps 20 and 21 a guide rail 23 extends on the ground for guiding the transporting carriage 9 between the two ramps. On the ramp 20 each can 8*h*–8*k* and 8*l*–8*n* is associated with a can position (presence) determining device, such as a sensor 22*a*, 22*b*, 22*c* and, 22*d*, 22*e* and 22*f*, respectively. By virtue of this arrangement the transporting carriage 9 is capable of handling cans from both sides, since, as already described in connection with the sequential FIGS. 3*a*–3*l*, the gripper element 13 may be arcuately turned approximately 180° as will be apparent upon a comparison of, for example, FIGS. 3*b* and 3*h* and further, the gripper element 13 may be linearly shifted outward from the carriage 9 to either side thereof as it is apparent from, for example, a comparison of FIGS. 3*c* and 3*i*.

Across from the transfer (telescoping) element 15 a guide rail is provided which may be shifted together with the transfer element 15 parallel therewith. During the transport of the can 8, the end 10' of the gripper element 13 which in the position illustrated in FIG. 4 is in the immediate vicinity of the transport element 15, projects beyond a vertical central plane of the coiler can 8. The central plane is oriented parallel to the travel direction of the transport carriage 9. In such an orientation, the end 10' serves as a braking counterelement making possible a more rapid can transport.

Figure 5:
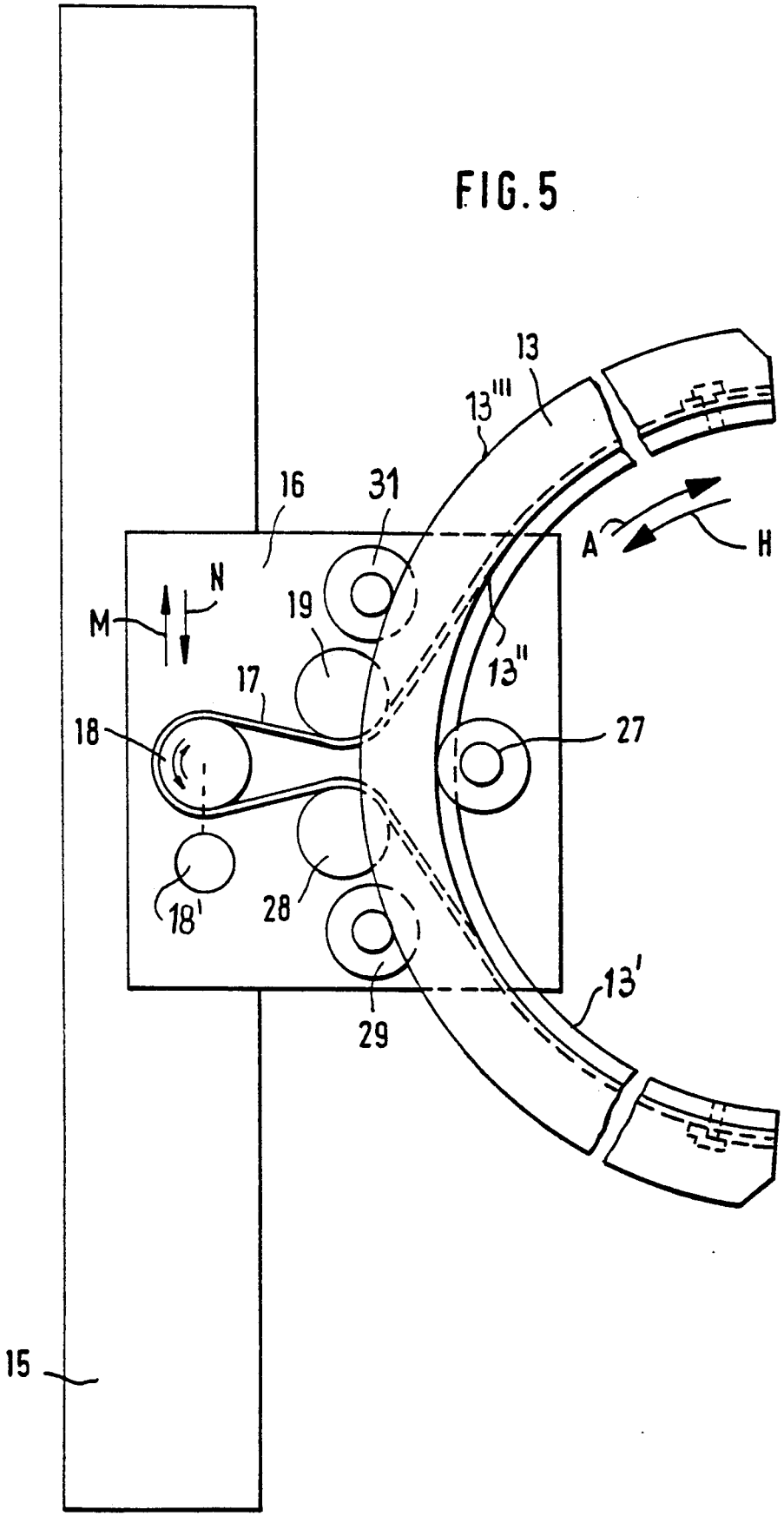
FIG. 5 is a top plan view of a further detail of the preferred embodiment.

Turning to FIG. 5, the one-piece gripper element 13 has the shape of a semicircular annular segment. The inner circular surface 13' of the gripper element 13 which serves as the engaging jaw surface has a diameter Which is greater than that of the can 8 so that an unobstructed entry and exit of the can 8 into and out of the concave curvature of the jaw opening is ensured. The gripper element 13 is mounted on the gripper carrier 16 which, in a sled-like fashion, is displaceable as indicated by the arrows M and N. A toothed belt 17 is secured to the gripper element 13 at both ends and is designed to have a loop which is guided around a drive sprocket 18 which, in turn, is rotated by a motor 18' accommodated, for example, in the chassis 11 of the carriage 19. The drive sprocket 18 is supported on the gripper carrier 16. The gripper carrier 16 further supports two deflecting rollers 19 and 28 for guiding the sprocket belt 17. Guide rollers 27, 29 and 31, also supported on the gripper carrier 16 are in engagement with inner and outer circular tracks 13", 13"' provided on the gripper element 13 for positioning and guiding the same when turned by the drive assembly 17, 18, 18'. The gripper carrier 16 is mounted on the telescoping cylinder 15 and is movable in the direction of the arrows M and N relative to the telescoping cylinder 15 and is also movable with the gripper carrier 16 in the direction of arrows B and I (FIGS. 3*c* and 3*i*) with the telescoping cylinder 15 as a unit. As the roller 18 is driven by the motor 18', the toothed belt 17 arcuately moves the gripper element 13 in the direction of the arrows A, H substantially in a path defined by the concave surface 13' of the gripper element 13.

Figure 6:
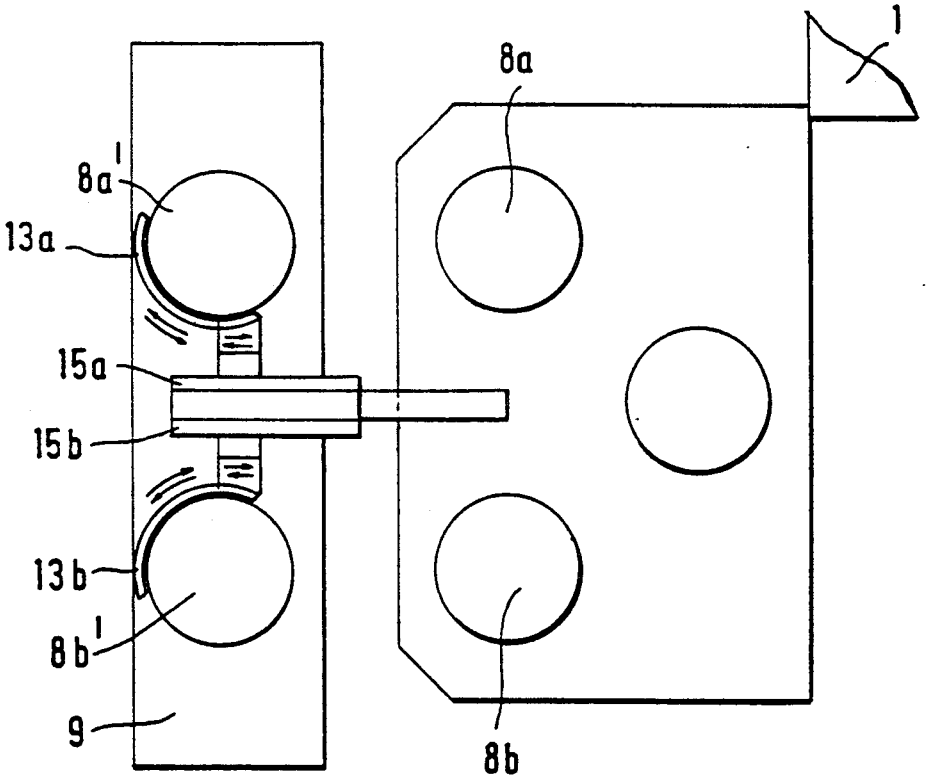
FIG. 6 is a schematic top plan view of another preferred embodiment of the invention.

In FIG. 6, there are shown two telescoping elements 15*a*, 15*b* each carrying a separate gripper element 13*a*, 13*b*. In this manner it is feasible to deposit an empty can 8 and to receive a full can 9 on the transport carriage 9 thus reducing the duration of the can handling cycles.

By virtue of the circumferential straddling arrangement of the gripper element 13 about the surface of the can 8 the force effect for shifting is on a greater circumferential surface sector of the can and, at the same time, a lateral escape of the can is effectively prevented.

It will be understood that the above description of the present invention is susceptible to various modifications, changes and adaptations, and the same are intended to be comprehended within the meaning and range of equivalents of the appended claims.

What is claimed is:

1. In a transporting carriage for conveying a coiler can of curved outer circumferential surface in an upright orientation between a can stand of a sliver producing fiber processing machine and a can stand of a sliver comsuming fiber processing machine, including an apparatus mounted on the carriage for transferring the coiler can from the carriage to a can stand and from a can stand to the carriage in a linear transferring direction; the improvement wherein said apparatus comprises (a) a gripper element having a jaw opening defined by an inner concave surface of the gripper element for engaging the coiler can along a portion of the curved outer circumferential surface; said concave surface having a curvilinear length;

(b) turning means for rotating said gripper element along a path generally parallel to said curvilinear length to alter an orientation of said jaw opening; and (c) linear shifting means for linearly displacing said gripper element parallel to said linear transferring direction for placing said gripper element into a first position in which it is situated within an outline of said carriage and into a second position in which it is situated externally of said outline.

2. The transporting carriage as defined in claim I, wherein said inner concave surface is substantially semicircular.

3. The transporting carriage as defined in claim 1, wherein said gripper element is a one-piece, rigid component.

4. The transporting carriage as defined in claim 1, wherein said gripper element has opposite ends, and said turning means comprises a flexible element attached to said ends of said gripper element and driving means for moving said flexible element.

5. The transporting carriage as defined in claim 1, further comprising a gripper element carrier for mounting said gripper element on said linear shifting means.

6. The transporting carriage as defined in claim 5, wherein said gripper element has opposite ends, and said turning means comprises (a) a flexible element attached to said ends of said gripper element;

(b) a roller supported on said gripper element carrier; said flexible element being trained about said roller, whereby said roller is force-transmittingly connected to said flexible element; and (c) a motor mounted on said gripper element carrier and being drivingly connected with said roller.

7. The transporting carriage as defined in claim 1, wherein said linear shifting means comprises a pneumatic power cylinder.

8. The transporting carriage as defined in claim 1, wherein said linear shifting means comprises a toothed rack drive.

9. In a transporting carriage for conveying coiler cans of curved outer circumferential surface in an upright orientation between a can stand of a sliver producing fiber processing machine and a can stand of a sliver consuming fiber processing machine, including an apparatus mounted on the carriage for transferring the coiler cans from the carriage to a can stand and from a can stand to the carriage in a linear transferring direction; the improvement wherein said apparatus comprises (a) first and second gripper elements each having a jaw opening defined by an inner concave surface of the gripper element for engaging the coiler can along a portion of the curved outer circumferential surface; said concave surface having a curvilinear length;

(b) first and second turning means for rotating said first and second gripper elements, respectively, along a path generally parallel to said curvilinear length of the first and second gripper elements, respectively, to alter an orientation of said jaw opening of the respective first and second gripper elements and (c) first and second linear shifting means for linearly displacing said first and second gripper elements, respectively, parallel to said linear transferring direction for placing said gripper elements into a first position in which they are situated within an outline of said carriage and into a second position in which they are situated externally of said outline.

10. In a method of transferring a coiler can of curved outer circumferential surface in an upright orientation between a can-supporting surface of a transporting carriage and a can-supporting surface of a stand, comprising the following steps:

(a) positioning the carriage adjacent the stand;

(b) turning a gripper element, mounted on the carriage and having a jaw opening provided with an inner concave surface for substantially form-fittingly engaging a curved outer circumferential surface of the coiler can, along said curved outer circumferential surface of the coiler can in the immediate vicinity thereof until said jaw opening is directed towards the can-supporting surface to which the coiler can is to be transferred; and (c) linearly shifting said gripper element, while in engagement with the coiler can, from above the can-supporting surface on which the coiler can is positioned, over the can-supporting surface to which the coiler can is to be transferred, whereby the coiler can is pushed by the gripper element from one of the can-supporting surfaces onto the other of said can-supporting surfaces.

11. The method as defined in claim 10, wherein said coiler can is to be transferred from the can-supporting surface of the carriage to the can-supporting surface of said stand; further comprising the step of linearly shifting, after step (c), the gripper element away from the coiler can situated on the can-supporting surface of said can, over the can-supporting surface of said carriage.

12. The method as defined in claim 10, wherein said coiler can is to be transferred from the can-supporting surface of said stand to the can-supporting surface of said carriage; further comprising the steps of:

(d) turning, before steps (b) and (c), the gripper element until said jaw opening is oriented towards the can situated on said can-supporting surface of said stand; and (e) linearly shifting, after step (d) and before steps (b) and (c), said gripper element from above the can-supporting surface of said carriage to the coiler can situated on the can-supporting surface of said stand.

13. The method as defined in claim 10, wherein the coiler can has an axial plane parallel to a direction of travel of the transporting carriage, further comprising the steps of (d) propelling the transporting carriage in the direction of travel while the coiler can is supported on the carriage and (e) turning said gripper element such that said plane intersects said inner arcuate concave surface of said gripper element during performance of step (d).

* * * * *